US009661975B2

(12) United States Patent
Charlton

(10) Patent No.: US 9,661,975 B2
(45) Date of Patent: May 30, 2017

(54) SPRAY MOP HAVING A PIVOTING LIQUID RESERVOIR ASSEMBLY

(71) Applicant: Techtronic Industries Co. Ltd., Tsuen Wan, New Territories (HK)

(72) Inventor: Christopher M. Charlton, Medina, OH (US)

(73) Assignee: Techtronic Industries Co., Ltd., Tsuen Wan, New Territories (HK)

( * ) Notice: Subject to any disclaimer, the term of this patent is extended or adjusted under 35 U.S.C. 154(b) by 96 days.

(21) Appl. No.: 14/838,060

(22) Filed: Aug. 27, 2015

(65) Prior Publication Data

US 2016/0058262 A1 Mar. 3, 2016

Related U.S. Application Data

(60) Provisional application No. 62/042,745, filed on Aug. 27, 2014.

(51) Int. Cl.

| | |
|---|---|
| ***A46B 11/00*** | (2006.01) |
| ***A47L 13/22*** | (2006.01) |
| ***B05B 9/01*** | (2006.01) |
| ***B05B 15/06*** | (2006.01) |

(52) U.S. Cl.

CPC ..... *A47L 13/22* (2013.01); *B05B 9/01* (2013.01); *B05B 15/06* (2013.01)

(58) Field of Classification Search

CPC ..... A47L 13/22; A47L 13/26; A47L 13/225; A47L 13/312

USPC ..... 401/137, 138, 140

See application file for complete search history.

(56) References Cited

U.S. PATENT DOCUMENTS

| | | | |
|---|---|---|---|
| 6,421,869 | B1 | 7/2002 | Olssen |
| 6,540,424 | B1 | 4/2003 | Hall et al. |
| D480,523 | S | 10/2003 | Hall et al. |
| 6,655,866 | B1 | 12/2003 | Morad et al. |
| 6,663,306 | B2 | 12/2003 | Policicchio et al. |
| 6,669,391 | B2 | 12/2003 | Policicchio et al. |
| D486,616 | S | 2/2004 | Hall et al. |
| D486,949 | S | 2/2004 | Rader et al. |
| 6,814,519 | B2 | 11/2004 | Policicchio et al. |
| D501,590 | S | 2/2005 | Hall et al. |
| 6,854,911 | B2 | 2/2005 | Policicchio et al. |
| 6,854,912 | B2 | 2/2005 | Dyer et al. |
| D503,253 | S | 3/2005 | Rader et al. |
| D503,836 | S | 4/2005 | Hall et al. |
| 6,893,180 | B2 | 5/2005 | Hall et al. |
| 6,899,485 | B2 | 5/2005 | Hall et al. |
| 6,910,823 | B2 | 6/2005 | Policicchio et al. |

(Continued)

FOREIGN PATENT DOCUMENTS

| | | |
|---|---|---|
| NL | 1033795 | 11/2008 |

OTHER PUBLICATIONS

International Search Report and Written Opinion for Application No. PCT/US2015/047244 dated Oct. 25, 2015 (10 pages).

*Primary Examiner* — Jennifer C Chiang
(74) *Attorney, Agent, or Firm* — Michael Best & Friedrich LLP

(57) ABSTRACT

A reservoir pivot assembly for a spray mop including a first portion pivotably connected to a second portion. A liquid reservoir is removably received by the first portion. The first portion is operable to pivot about the second portion between a first state and a second state, and the liquid reservoir is configured to pivot with the first portion.

20 Claims, 8 Drawing Sheets

(56) References Cited

U.S. PATENT DOCUMENTS

| | | | | |
|---|---|---|---|---|
| 6,948,873 | B2 | 9/2005 | Policicchio et al. | |
| 6,964,535 | B2 | 11/2005 | Bell et al. | |
| 6,976,802 | B2 | 12/2005 | Hall et al. | |
| 6,986,618 | B2 | 1/2006 | Hall et al. | |
| 6,986,619 | B2 | 1/2006 | Hall et al. | |
| 6,995,128 | B2 | 2/2006 | Mitra et al. | |
| 7,004,658 | B2 | 2/2006 | Hall et al. | |
| 7,048,458 | B2 | 5/2006 | Hall et al. | |
| 7,160,044 | B2 | 1/2007 | Dyer et al. | |
| 7,163,349 | B2 | 1/2007 | Policicchio et al. | |
| 7,172,099 | B2 * | 2/2007 | Hofte ..... | A47L 13/22 222/481.5 |
| 7,182,537 | B2 | 2/2007 | Policicchio et al. | |
| 7,708,484 | B2 | 5/2010 | Tanaka et al. | |
| 7,708,485 | B2 | 5/2010 | Tanaka et al. | |
| 7,722,273 | B2 | 5/2010 | Tanaka et al. | |
| 8,241,427 | B1 | 8/2012 | Crawford et al. | |
| 8,449,212 | B2 | 5/2013 | Crawford et al. | |
| 8,662,778 | B2 | 3/2014 | Crawford et al. | |
| 2004/0223803 | A1 | 11/2004 | Fahy et al. | |
| 2006/0039743 | A1 | 2/2006 | Mensink et al. | |
| 2006/0171768 | A1 | 8/2006 | Hoadley et al. | |
| 2006/0280546 | A1 | 12/2006 | Dyer | |
| 2007/0231046 | A1 | 10/2007 | Whiffen et al. | |
| 2010/0047459 | A1 | 2/2010 | Crawford et al. | |
| 2011/0005025 | A1 | 1/2011 | Carrignton et al. | |

* cited by examiner

SPRAY MOP HAVING A PIVOTING LIQUID RESERVOIR ASSEMBLY

CROSS-REFERENCE TO RELATED APPLICATIONS

This application claims priority to U.S. Provisional Patent Application No. 62/042,745, filed on Aug. 27, 2014, the contents is hereby incorporated by reference in its entirety.

FIELD OF THE INVENTION

The present invention relates to a spray mop. More specifically, the present invention relates to an assembly for a spray mop liquid reservoir that pivots to facilitate reservoir installation and removal.

BACKGROUND

A spray mop is a portable cleaning device that includes a source of cleaning liquid, a liquid distribution device that distributes liquid over a targeted surface to be cleaned, and a surface engaging member that carries a pad to absorb the liquid and dirt (or other contaminants) while cleaning. The cleaning liquid source is generally a removable container that holds water, cleaning solution, or any other desired liquid. The container is removably received by a housing provided on the spray mop. The housing contains components that fluidly connect the container to the liquid distribution device. Additionally, in known spray mops the container is aligned with or is parallel to a handle of the spray mop. This alignment allows a user to manipulate the position of the container, for example to use gravity to transfer liquid from the container to the liquid distribution device, by manipulating the position of the handle.

A user typically removes the container from the spray mop in order to refill or replace the container. To facilitate removal of the container, the user withdraws the container from the spray mop. Since known spray mops incorporate a unitary housing that receives the container, the user removes the container along an axis parallel to the spray mop handle. Similarly, a user installs a refilled or new container into the spray mop along the axis parallel to the spray mop handle.

SUMMARY OF THE INVENTION

The invention provides, in one aspect, a reservoir pivot assembly for a spray mop including a first portion pivotably connected to a second portion. A liquid reservoir is removably received by the first portion. The first portion is operable to pivot about the second portion between a first state and a second state, and the liquid reservoir is configured to pivot with the first portion.

The invention provides, in another aspect, a spray mop including a handle, a head portion attached to the handle, a pivot assembly attached to the handle, the reservoir pivot assembly including a first portion pivotably connected to a second portion, and a reservoir removably received by the first portion, wherein the first portion pivots about the second portion between a first position and a second position, the reservoir being removable from the pivot assembly in the second position.

The invention provides, in another aspect, a spray mop including a handle, a head portion attached to the handle, and a reservoir pivotably connected to the handle and in fluid communication with a spray nozzle, wherein the reservoir pivots between a first position and a second position.

The invention provides, in another aspect, a spray mop including a handle portion and a head portion attached to the handle portion, a housing provided on the handle portion or the head portion movable between a first position and a second position, and a reservoir removably received by the housing such that when the reservoir is received by the housing the reservoir is connected to a liquid distribution system operable to deliver a fluid from the reservoir, where the reservoir is removable from the housing in the second position.

Other features and aspects of the invention will become apparent by consideration of the following detailed description and accompanying drawings.

Figure 1:
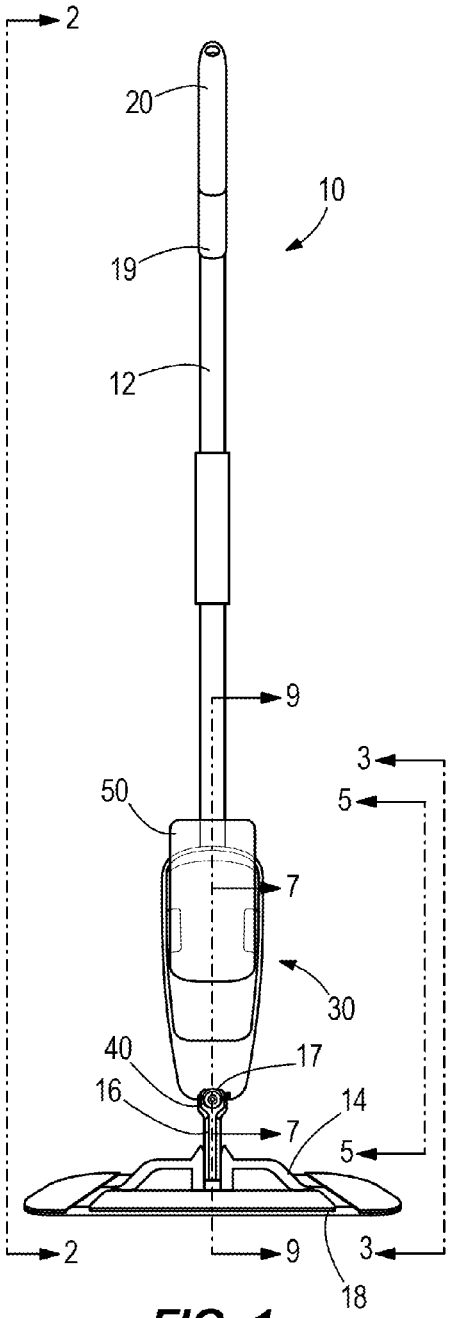
FIG. 1 is an elevation view of a wet mop incorporating a reservoir pivot assembly in accordance with an embodiment of the invention.

Before any embodiments of the present invention are explained in detail, it should be understood that the invention is not limited in its application to the details or construction and the arrangement of components as set forth in the following description or as illustrated in the drawings. The invention is capable of other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

The invention illustrated in the Figures and disclosed herein is generally directed to a reservoir pivot assembly 30 that pivots a liquid reservoir 50 to facilitate removal and installation. The reservoir pivot assembly 30 includes a first portion 32 that is pivotably connected to a second portion 34. The second portion 34 is coupled to a handle 12 of a spray mop 10. The first portion 32 receives or carries the removable liquid reservoir 50 to facilitate pivoting of the liquid reservoir 50 away from the second portion 34, or away from the associated handle 12 of the spray mop 10. The reservoir pivot assembly 30 provides improved access and easier removal and installation of the liquid reservoir 50.

Referring now to the Figures, FIGS. 1-12 illustrate a spray mop or wet mop 10 that incorporates an embodiment of the reservoir pivot assembly 30. It should be appreciated that the spray mop 10 is provided for purposes of illustration, and any device that sprays or atomizes a liquid stored or retained in a liquid reservoir 50 can incorporate the reservoir pivot assembly 30.

Figure 2:
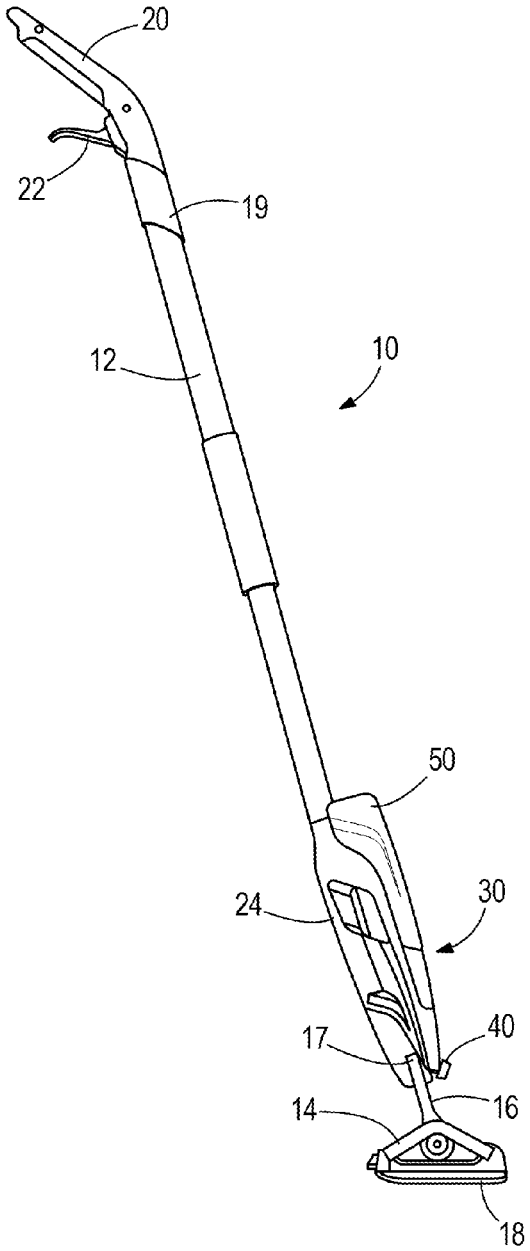
FIG. 2 is a side view of the wet mop of FIG. 1, taken along line 2-2 of FIG. 1, illustrating the wet mop of FIG. 1.

Referring to FIGS. 1 and 2, the spray mop 10 includes a handle 12 coupled to a head portion or head 14 by a pivoting connection 16 at a first end 17 of the handle 12. The head portion 14 includes a bottom surface 18 adapted to engage a cleaning media (not shown), for example a washable or a replaceable cleaning pad. The pivoting connection 16 allows the handle 12 to move about the head portion 14 while the bottom surface 18 remains in contact with a surface targeted for cleaning, such as a floor.

The handle 12 includes a grip or hand grip 20 (shown in FIG. 2) at a second end 19 of the handle 12, opposite the first end 17. A trigger 22 is positioned on the handle 12 and proximate the grip 20 to allow a user to actuate the trigger 22 while grasping or otherwise holding the grip 20. The handle 12 also carries the reservoir pivot assembly 30 and the liquid reservoir 50. The reservoir pivot assembly 30 removably receives the liquid reservoir 50, which contains a liquid dispersible by the spray mop 10 through a nozzle 40. In the illustrated embodiment, the nozzle 40 is coupled to the spray mop 10 by the reservoir pivot assembly 30, and is fluidly connected to the liquid reservoir 50. In alternative embodiments, the nozzle 40 may be coupled to the head 14 or any other portion or component of the spray mop 10 suitable for spraying liquid from the liquid reservoir 50 onto a desired or targeted location to be cleaned (e.g., a floor, a surface, etc.). The liquid reservoir 40 can include any suitable or desired liquid (e.g., water, cleaning solution, a combination thereof, etc.).

Figure 3:
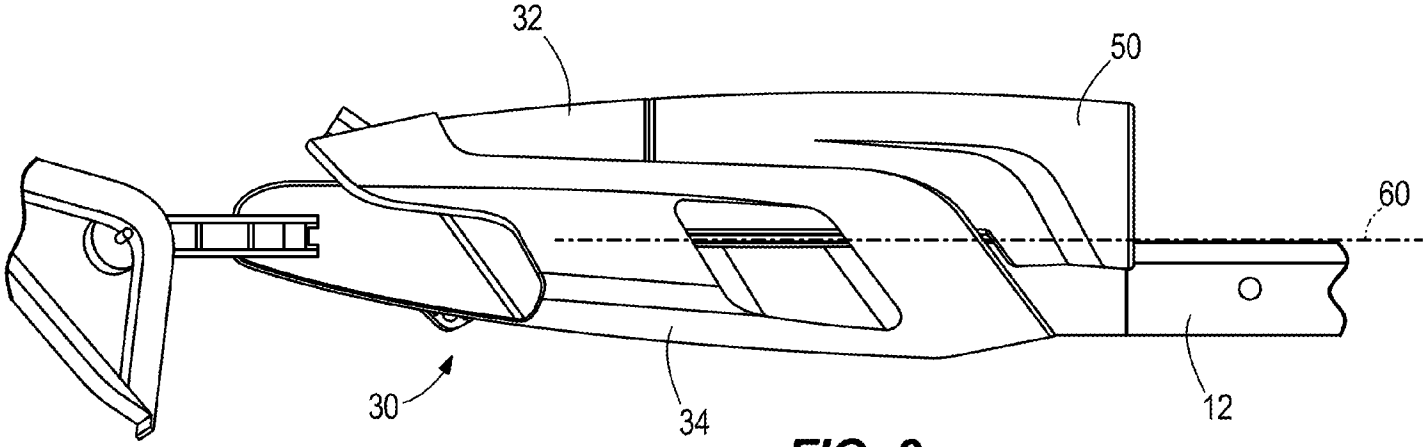
FIG. 3 is a partial side view of the wet mop of FIG. 1, taken along line 3-3 of FIG. 1, illustrating the reservoir pivot assembly and a liquid reservoir in a first position.
Figure 4:
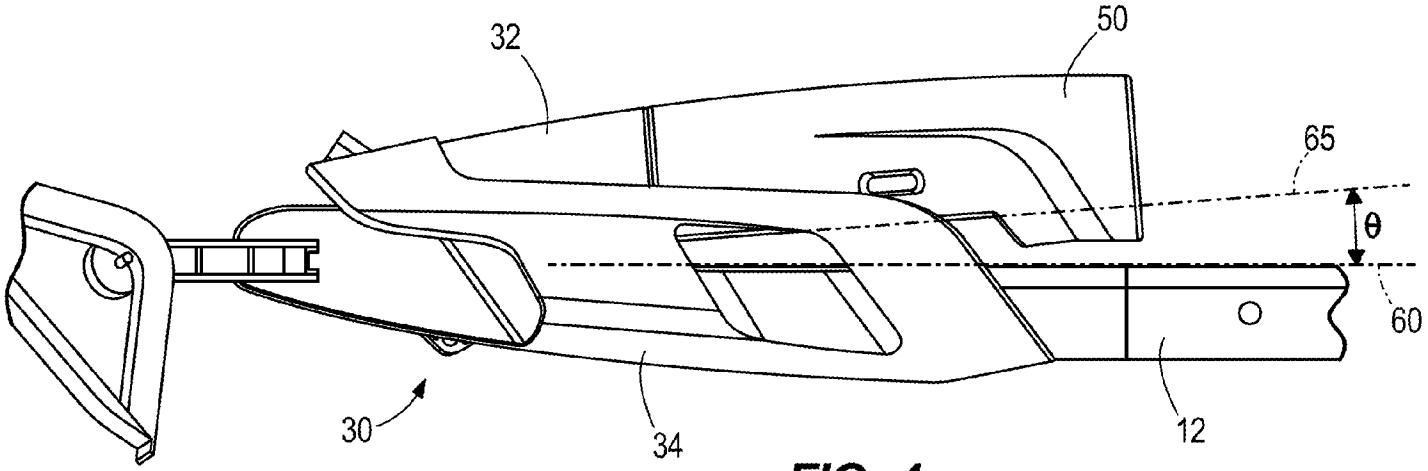
FIG. 4 is a partial side view of the wet mop of FIG. 1, shown from a similar view as FIG. 3, illustrating the reservoir pivot assembly and the liquid reservoir in a second position, where the liquid reservoir has pivoted away from a portion of the reservoir pivot assembly to facilitate reservoir removal.

Referring now to FIGS. 3 and 4, the reservoir pivot assembly 30 includes a first portion or first housing 32 that is pivotably connected to a second portion or second housing 34. The liquid reservoir 50 is removably received by the first portion 32. As the first portion 32 pivots about (or away from) the second portion 34, the liquid reservoir 50 travels with the first portion 32.

Referring to FIG. 3, the reservoir pivot assembly 30 is illustrated in a first position or first state or first configuration. In this position, the liquid reservoir 50 is in contact with or engages both the first and second portions 32, 34 of the reservoir pivot assembly 30. The liquid reservoir 50 is also in a position to dispense liquid retained by the liquid reservoir 50 in accordance with operation of the spray mop 10 as disclosed herein. As a reference to illustrate how the first portion 32 pivots about the second portion 34, FIG. 3 illustrates a first or reference axis 60.

Referring to FIG. 4, the reservoir pivot assembly 30 is illustrated in a second position or second state of second configuration. In this position, the first portion 32 has pivoted away from the second portion 34. Since the liquid reservoir 50 is received by the first portion 32 in the illustrated embodiment, the liquid reservoir 50 has also pivoted about or away from the second portion 34. The liquid reservoir 50 has additionally pivoted away from the handle 12. After pivoting, the first portion 32 and the liquid reservoir 50 are provided along a second axis 65, which is positioned a distance away from the first axis 60. In this second position, the liquid reservoir 50 may be removed from, or installed in, the reservoir pivot assembly 30 and/or the first portion 32. In the second position, the liquid reservoir 50 is also disengaged from any locking assembly 90 provided on the reservoir pivot assembly 30 to facilitate removal and/or installation of the liquid reservoir 50. The distance between the first and second axis 60, 65, or the distance between the liquid reservoir 50 and handle 12, or the distance between the liquid reservoir 50 and the second portion 34 in the second position may be any distance suitable to facilitate removal or installation of the liquid reservoir 50.

It should be appreciated that the reference axis 60 and the second axis 65 may be an axis of the same component in different positions or configurations. For example, in the illustrated embodiment, the reference axis 60 is an axis of the first portion 32 and/or liquid reservoir 50 in the first position, while the second axis 65 is an axis of the first portion 32 and/or liquid reservoir 50 in the second position. In other embodiments, the reference axis 60 may be associated with a non-pivoting or otherwise static portion of the spray mop 10, such as, but not limited to, the second portion 34, along the handle 12, through the handle 12, or any other static or nonmoving portion of the spray mop 10 (static or nonmoving in relation to the first portion 32, liquid reservoir 50, or other pivoting portion). While the second axis 65 is illustrated as an axis of the second portion 34, or an axis along which a portion of the liquid reservoir 50 extends, in other embodiments the second axis 65 may be any suitable axis along which the second portion 34, a portion of the pivot assembly 30, or other pivoting or moving portion of the spray mop 10.

In the second position, the second axis 65 may be provided at an angle θ away from the first axis 60. The angle θ may be within a range of between approximately 0 and 60 degrees, and more specifically may be within a range of between approximately 0 and 40 degrees, and more specifically may be within a range of between approximately 0 and 20 degrees, and more specifically may be within a range of between approximately 0 and 10 degrees, and more specifically may be approximately 5 degrees. In other embodiments, the second axis 65 may be provided any angle θ and/or any distance away from the first axis 60 suitable to facilitate removal or installation of the liquid reservoir 50 from or with the reservoir pivot assembly 30 and/or the first portion 32. While the angle θ is illustrated as between the first and second axes 60, 65, in other embodiments the angle θ may be illustrative of the angle formed between the liquid reservoir 50 and the handle 12 of the spray mop 10, the angle formed between the liquid reservoir 50 and the second portion 34, the angle formed between the first and second portions 32, 34, the angle formed between the first portion 32 and any other static portion of the spray mop 10 (static in relation to the first portion 32), and/or the angle formed between the liquid reservoir 50 and any other static portion of the spray mop 10 (static in relation to the liquid reservoir 50).

Figure 6:
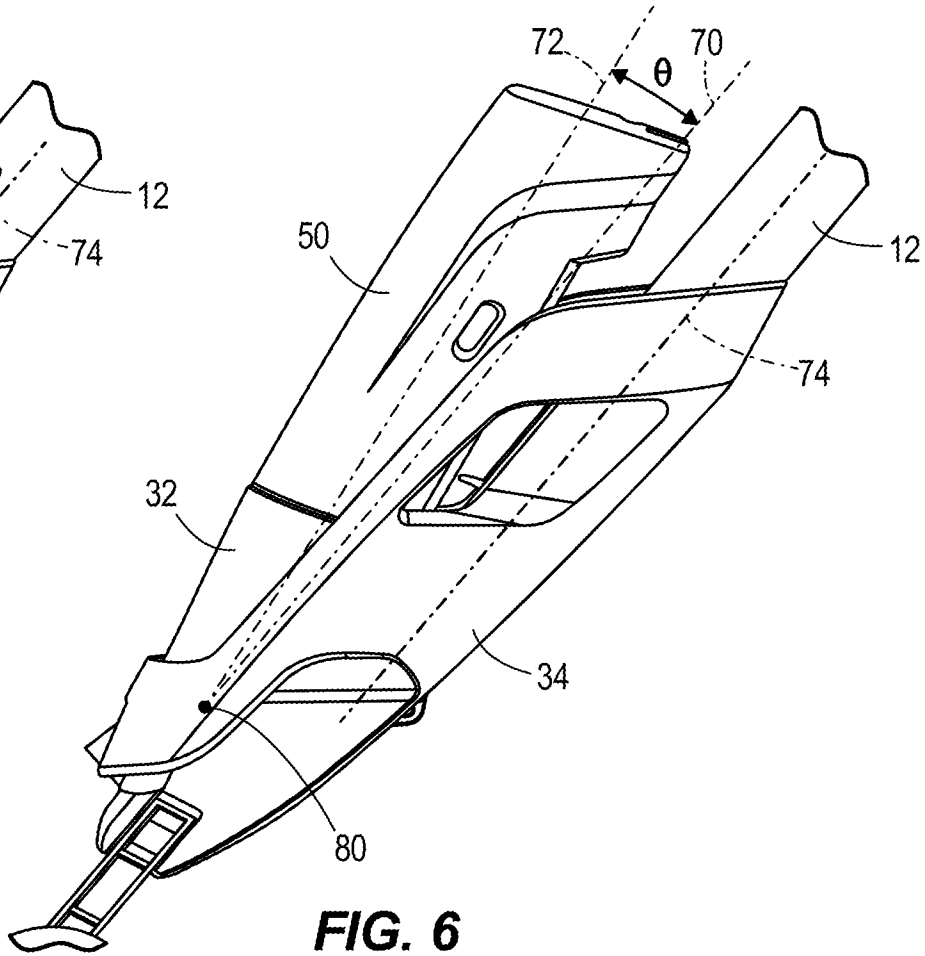
FIG. 6 is a partial side view of the wet mop of FIG. 1, shown from a similar view as FIG. 5, illustrating the reservoir pivot assembly and the liquid reservoir in the second position.
Figure 5:
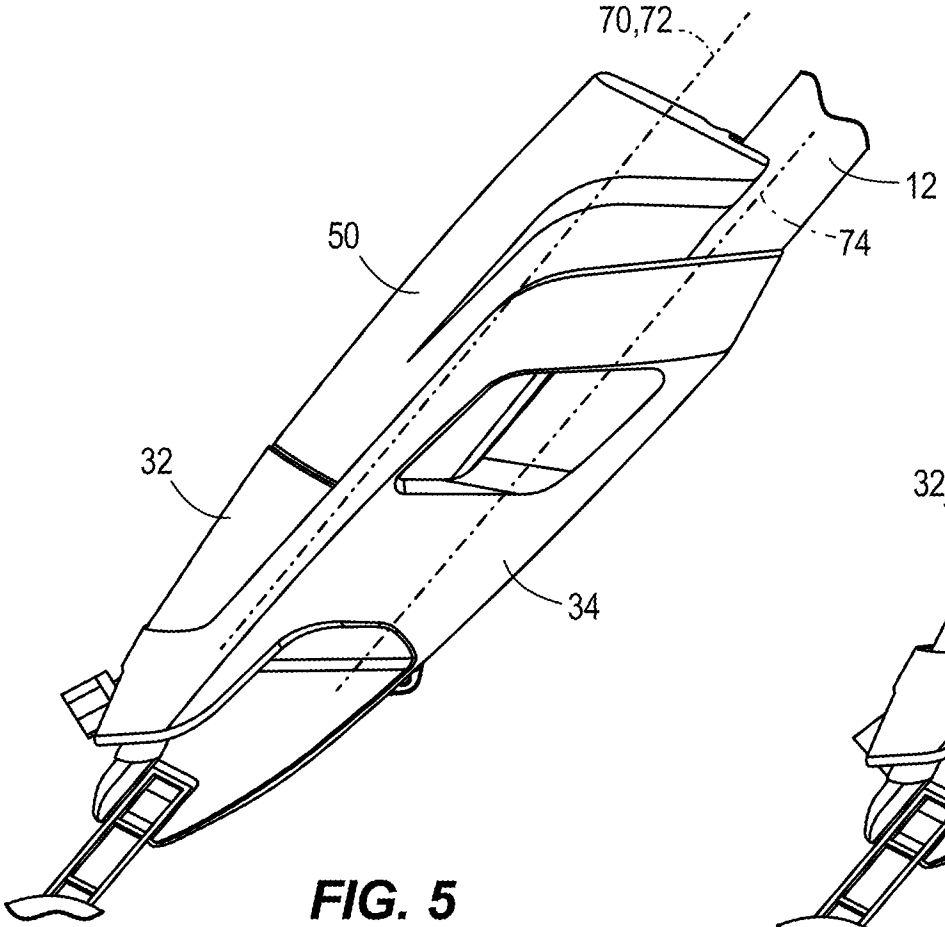
FIG. 5 is a partial side view of the wet mop of FIG. 1, taken along line 5-5 of FIG. 1, illustrating the reservoir pivot assembly and the liquid reservoir in the first position.

Referring now to FIGS. 5 and 6, the first and second positions of the first portion 32 and the liquid reservoir 50 are illustrated with different axes. In these illustrations, the second portion 34 is provided along a first axis 70. The first axis 70 intersects a pivot axis 80 of the first portion 32 (shown in FIG. 6). The first portion 32 and the liquid reservoir 50 are provided along a second axis 72. The second axis 72 also intersects the pivot axis 80 of the first portion 32 (shown in FIG. 6). The handle 12 is provided along a third axis 74. The first and second axes 70, 72 not only intersect the pivot axis 80, but are approximately perpendicular to the pivot axis 80. The third axis 74 is offset from the first and second axes 70, 72.

Referring now to FIG. 5, the reservoir pivot assembly 30 is illustrated in the first position. In the first position, the first axis 70 and the second axis 72 share the same axis. The first and second axes 70, 72 are offset from the third axis 74. Alternatively, or in addition, the first and second axes 70, 72 may be approximately or substantially parallel, or parallel, to the third axis 74. Again, in the first position the liquid reservoir 50 is fluidly connected to the nozzle 40 to allow distribution of liquid stored in the liquid reservoir 50.

Referring to FIG. 6, the reservoir pivot assembly 30 is illustrated in the second position. In the second position, the first portion 32 and the liquid reservoir 50 have moved away from the second portion 34. The liquid reservoir 50 (and first portion 32) has also moved away from the handle 12. Accordingly, the liquid reservoir 50 has an increased distance away from the second portion 34 and the handle 12 in the second position than in the first position. Stated another way, an angle formed between the liquid reservoir 50 and the second portion 34 and/or the handle 12 is greater in the second position than in the first position. Similarly, the first portion 32 has an increased distance away from the second portion 34 and the handle 12 in the second position than in the first position. Stated another way, an angle formed between the first portion 32 and the second portion 34 and/or the handle 12 is greater in the second position than in the first position.

In the illustrated embodiment, the second axis 72 has pivoted away from the first axis 70 to form angle θ between the axes 70, 72. The angle θ between the axes 70, 72 is greater in the second position than in the first position. The second axis 72 is also no longer approximately or substantially parallel, or parallel, to the third axis 74. The second axis 72 also has an increased distance away from the first axis 70 and the third axis 74. In various alternatives, the reservoir pivot assembly 30 does not move in a pivoting motion but translates or otherwise moves between the first position and the second position.

The first and second axes 70, 72 may be an axis of the same component in different positions or configurations (e.g., the first and second positions, etc.). In other examples of embodiments, the first axis 70 may be associated with any nonmoving or otherwise static portion of the spray mop 10 (static or nonmoving in relation to the first portion 32, liquid reservoir 50, or other moving portion), such as, but not limited to, the second portion 34, along a portion of the handle 12, or through a portion of the handle 12. The second axis 72 may be associated with a pivoting or otherwise moving portion of the spray mop 10, such as, but not limited to, the first portion 32, the liquid reservoir 50, or other suitable moving or pivoting portion of the pivot assembly 30.

Figure 7:
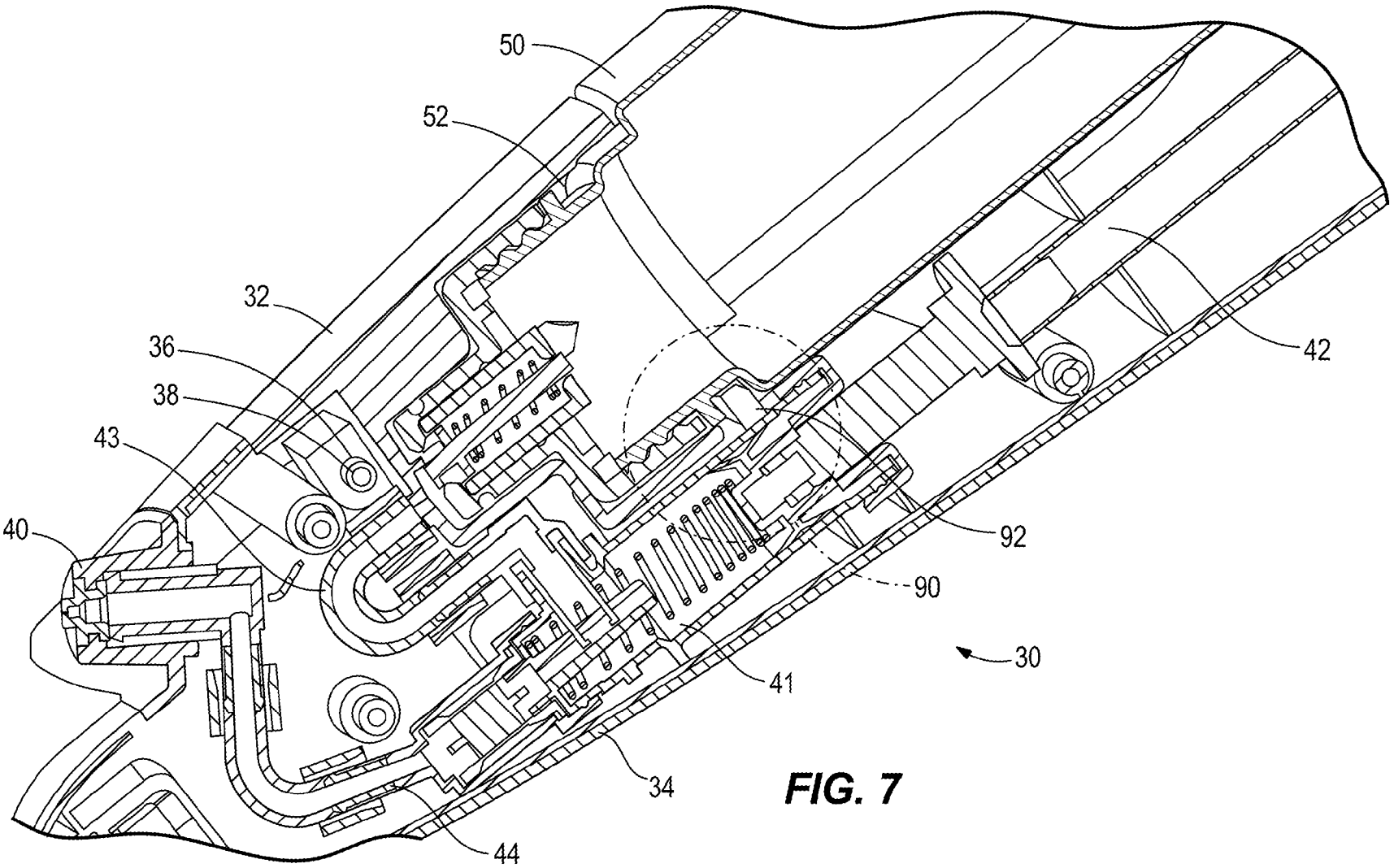
FIG. 7 is a cross-sectional view of the wet mop of FIG. 1, taken along line 7-7 of FIG. 1, illustrating components of the reservoir pivot assembly while the pivot assembly is in the first position and a locking assembly is in an engaged position.
Figure 8:
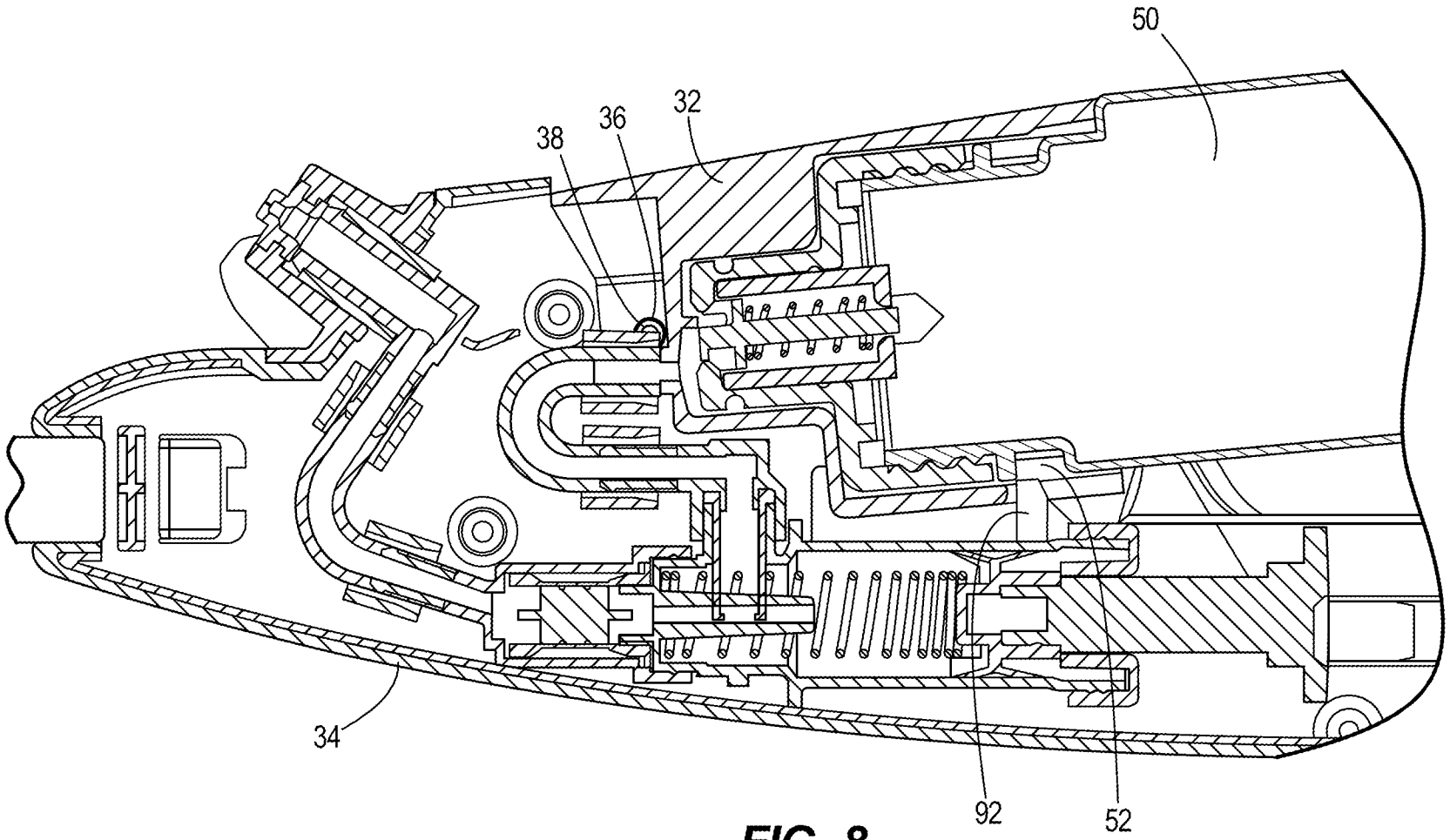
FIG. 8 is a cross-sectional view of the wet mop of FIG. 1, shown from a similar view as FIG. 7, illustrating components of the reservoir pivot assembly while the pivot assembly is in the second position and the locking assembly in a disengaged position.
Figure 10:
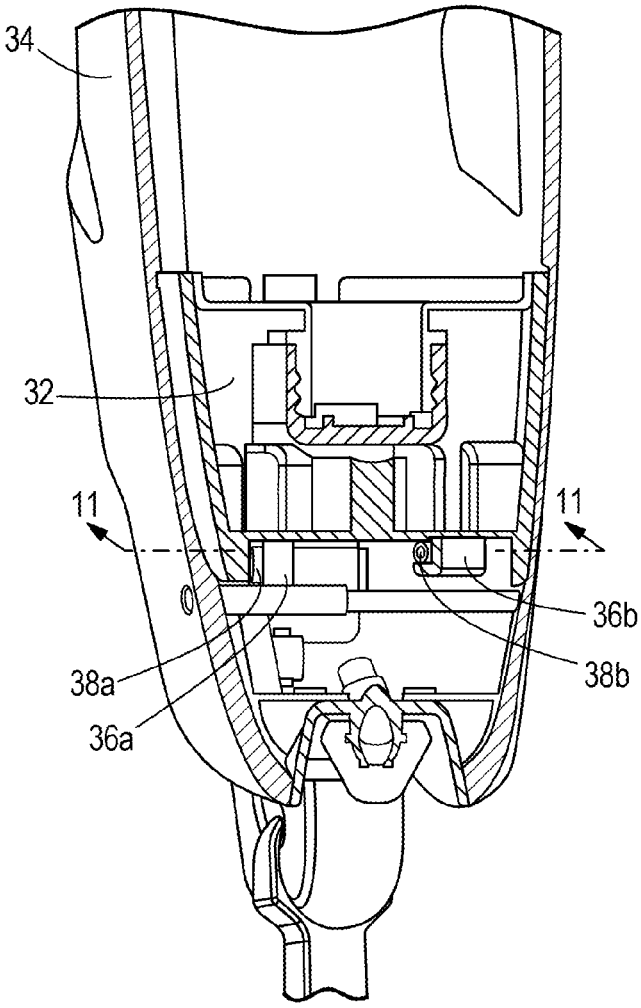
FIG. 10 is a cross-sectional view of the wet mop of FIG. 1, taken along line 10-10 of FIG. 9, illustrating the pivot apertures and pivot members that define the pivot axis for the reservoir pivot assembly.
Figure 11:
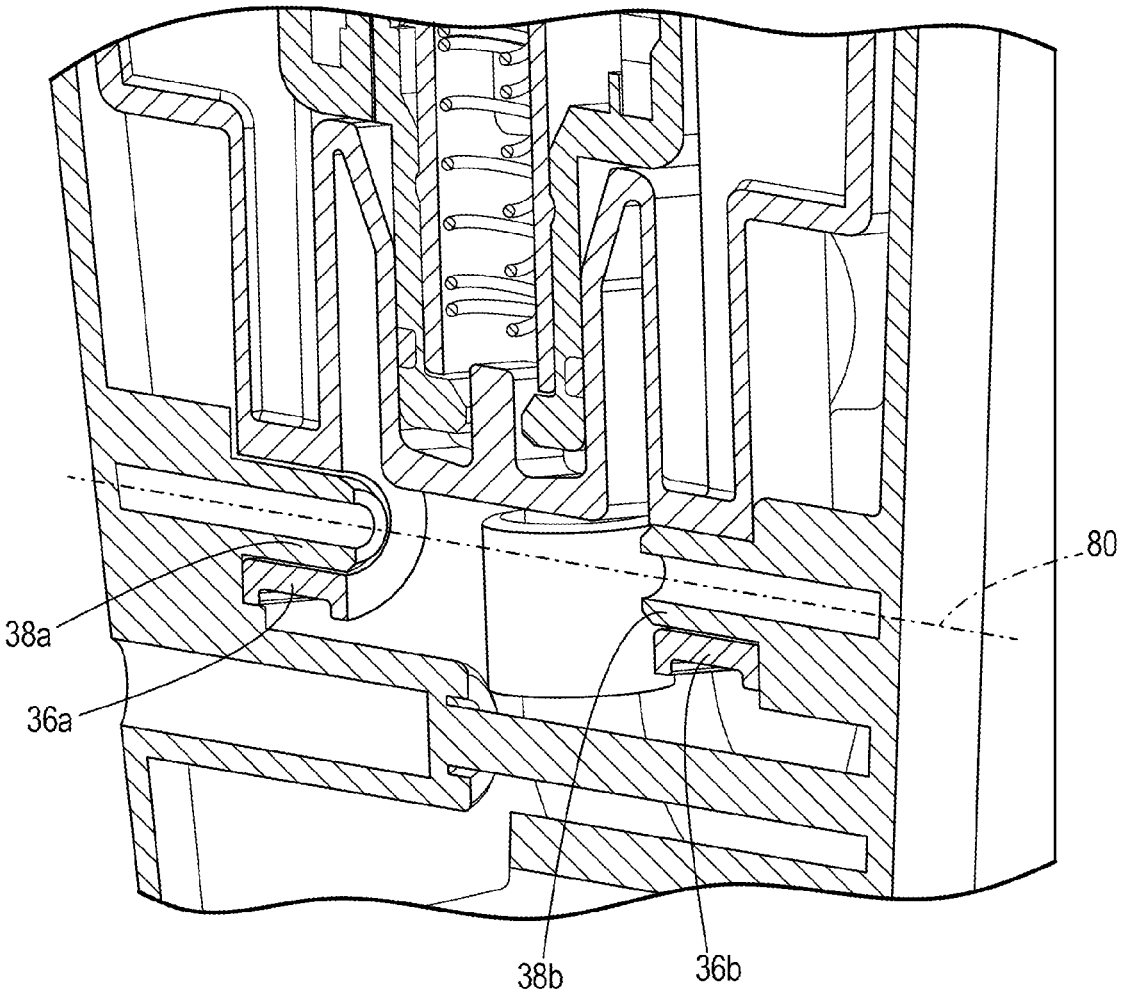
FIG. 11 is a cross-sectional view of the wet mop of FIG. 1, taken along line 11-11 of FIG. 10, illustrating the pivot apertures and pivot members that define the pivot axis for the reservoir pivot assembly.
Figure 12:
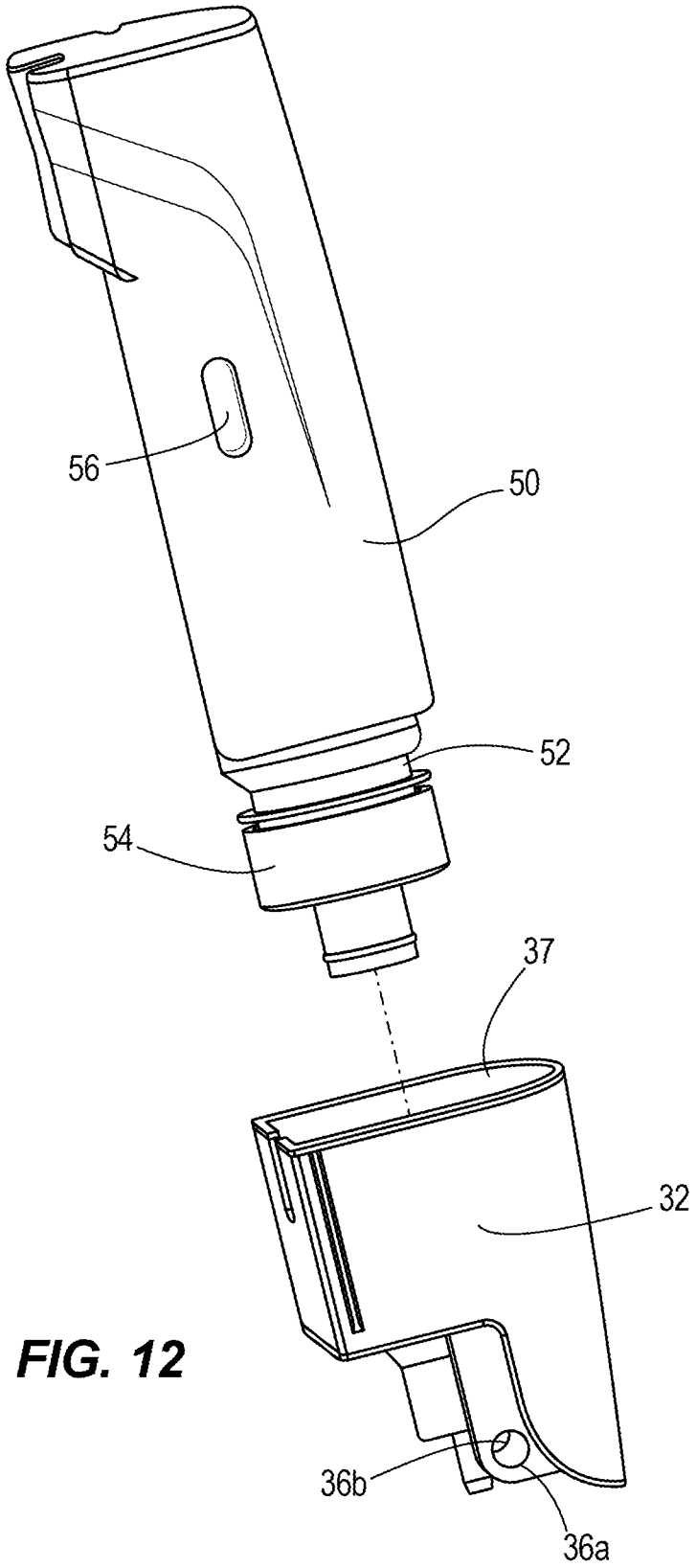
FIG. 12 is a partial exploded view of the liquid reservoir and first portion of the reservoir pivot assembly shown in FIG. 1.

Referring now to FIGS. 7 and 8, a cross-sectional view of the reservoir pivot assembly 30 is provided. The first portion 32 includes one or more pivot apertures 36 that receive a pivot member 38 mounted to the second portion 34. The pivot member 38 defines the pivot axis 80 (as shown in FIG. 11), allowing the first portion 32 to pivot about the second portion 34. As illustrated in FIGS. 10-12, the first portion 32 includes a pair of pivot apertures 36*a, b* that respectively receive a separate pivot member 38*a, b* (shown in FIGS. 10-11). Pivot members 38*a, b* also define the pivot axis 80 (shown in FIG. 11). Referring to FIG. 12, the first portion 32 defines a cup 37 that receives a portion of the liquid reservoir 50. The liquid reservoir 50 also includes a slot or channel 52. The channel 52 can be defined by a portion of the liquid reservoir 50. A cap 54 is removably connected to the liquid reservoir 50 to keep liquid in the liquid reservoir 50 when not engaged with the pivot assembly 30. The cap 54 can be removed to facilitate filling or refilling of the liquid reservoir 50. The liquid reservoir 50 also can include at least one recess 56 positioned on the liquid reservoir 50.

Referring back to FIG. 7 a reservoir locking or retention assembly 90 is illustrated. In FIG. 7, the reservoir pivot assembly 30 and associated liquid reservoir 50 are provided in the first position. In the first position, the locking assembly 90 assists in retaining the liquid reservoir 50 in the first portion 32. The locking assembly 90 includes a locking projection 92 extending from the second portion 34. When in the first position, the locking projection 92 is received by the channel 52 of the liquid reservoir 50 (or the locking projection 92 engages the channel 52). This obstructs withdrawal or removal of the liquid reservoir 50 from the reservoir pivot assembly 30.

Referring now to FIG. 8, the reservoir pivot assembly 30 and associated liquid reservoir 50 are provided in the second position. In the second position, the first portion 32 and associated liquid reservoir 50 are pivoted away from the second portion 34. When pivoted away, the channel 52 is withdrawn from the locking projection 92 (or the locking projection 92 is disengaged from the channel 52). This provides for the unobstructed withdrawal or removal of the liquid reservoir 50 from the reservoir pivot assembly 30 when in the second position. During installation or reinstallation of the liquid reservoir 50 into the reservoir pivot assembly 30, after placement into the reservoir pivot assembly 30, the liquid reservoir 50 pivots from the second position to the first position. In the first position, the locking projection 92 is received by the channel 52 to obstruct withdrawal or removal of the liquid reservoir 50 from the reservoir pivot assembly 30.

The locking assembly 90 may also include an interference fit locking assembly to further assist in retaining the liquid reservoir 50 in the reservoir pivot assembly 30. The second portion 34 may include one or more projections or detents (not shown) that are received by corresponding recesses 56 provided on the liquid reservoir 50 (shown in FIG. 12). In the first position, the one or more detents (not shown) engage the one or more recesses 56 to assist in retaining the liquid reservoir 50 in the reservoir pivot assembly 30. When pivoting the reservoir pivot assembly 30 to the second position, the recesses 56 are disengaged from the associated detents (not shown), allowing the liquid reservoir 50 to pivot and subsequently be removed from the reservoir pivot assembly 30. During installation or reinstallation of the liquid reservoir 50 into the reservoir pivot assembly 30, after placement into the reservoir pivot assembly 30, the liquid reservoir 50 pivots from the second position to the first position, where the recesses 56 provided on the liquid reservoir 50 engage the detents (not shown).

Figure 9:
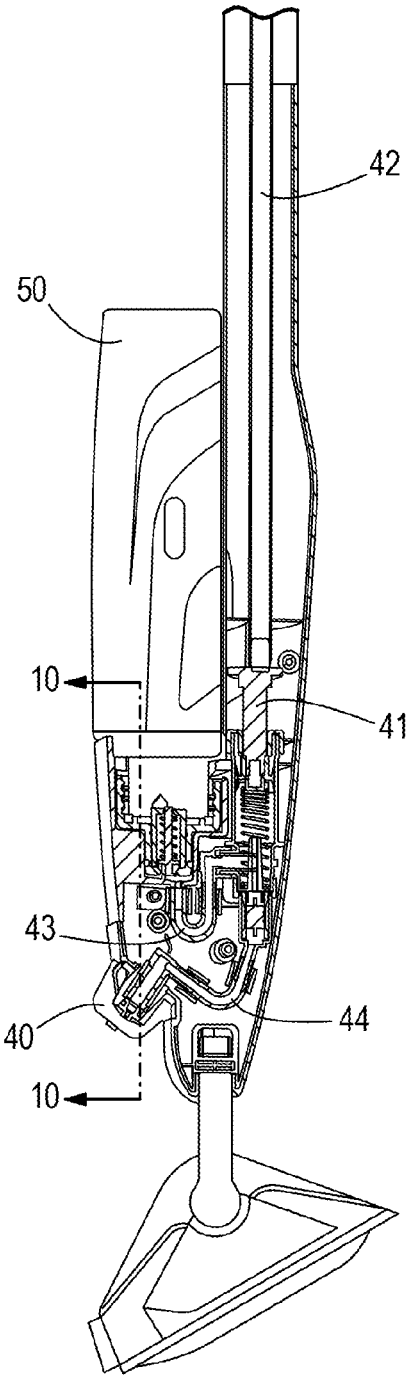
FIG. 9 is cross-sectional view of the wet mop of FIG. 1, taken along line 9-9 of FIG. 1, illustrating components of the wet mop and reservoir pivot assembly.

Referring now to FIGS. 7 and 9, the reservoir pivot assembly 30 houses a liquid distribution assembly that fluidly connects the liquid reservoir 50 to the nozzle 40. The liquid distribution assembly includes a pump 41 actuatable by the trigger 22 (shown in FIG. 2) through a rod 42. The pump 41 is illustrated as a mechanically actuated piston pump that draws liquid from the reservoir 50 through a supply line 43 and discharges the liquid into a discharge line 44 to and through the nozzle 40. In other embodiments, the pump 41 may be an electric pump. The liquid distribution assembly is positioned in a housing that can be defined or partially defined by the reservoir pivot assembly 30, and more specifically the second portion or housing 34.

The reservoir pivot assembly 30 provides for improved access, retention, and removal of the liquid reservoir 50. By pivoting the liquid reservoir 50 a user can more easily remove and/or install the reservoir 50 to an associated spray mop 10 (or to the reservoir pivot assembly 30). The locking assembly also assists in retaining the liquid reservoir 50 to the spray mop 10 (or to the reservoir pivot assembly 30), reducing the risk of unintentional or unwanted removal of the liquid reservoir 50, limiting spills or other unintentional discharge of the liquid in the liquid reservoir 50. These and other advantages may be realized from one or more embodiments of the reservoir pivot assembly 30 disclosed herein.

What is claimed is:

1. A reservoir pivot assembly for a spray mop comprising:
a first portion pivotably connected to a second portion, the first portion defining a cup; and
a liquid reservoir removably received by the cup,
wherein the first portion is operable to pivot about the second portion between a first state and a second state, and the liquid reservoir is configured to pivot with the first portion, the cup carrying the liquid reservoir as the first portion pivots between the first state and the second state.

2. The reservoir pivot assembly of claim 1, wherein an angle formed between the liquid reservoir and the second portion is greater in the second state than in the first state.

3. The reservoir pivot assembly of claim 1, wherein a locking assembly obstructs removal of the liquid reservoir from the first portion in the first state.

4. The reservoir pivot assembly of claim 3, wherein the locking assembly includes a locking projection positioned on the second portion that is configured to engage a portion of the liquid reservoir when the pivot assembly is in the first state.

5. The reservoir pivot assembly of claim 1, further comprising a handle coupled to a housing that carries the second portion.

6. The reservoir pivot assembly of claim 5, further comprising a pump provided in the housing and fluidly connecting the liquid reservoir to a nozzle coupled to the housing.

7. The reservoir pivot assembly of claim 5, further comprising a head portion configured to engage a surface to be cleaned, the head portion coupled to the handle.

8. The reservoir pivot assembly of claim 1, wherein the first portion is positioned along a first axis, the second portion is positioned along a second axis, and the first portion pivots about the second portion along a pivot axis that is perpendicular to the first and second axes.

9. The reservoir pivot assembly of claim 8, wherein an angle formed between the first and second axes is greater in the second state than the first state.

10. The reservoir pivot assembly of claim 1, further comprising a member positioned on the second portion and configured to be received by the first portion to restrict removal of the liquid reservoir from the cup in the first state, and further configured to be withdrawn from the first portion to allow for removal of the liquid reservoir from the cup in the second state.

11. A spray mop comprising:
a handle;
a head portion attached to the handle;
a reservoir pivot assembly attached to the handle, the reservoir pivot assembly including:
a first portion pivotably connected to a second portion;
a reservoir removably received by the first portion; and
a locking assembly positioned on the first portion and configured to selectively engage the reservoir,
wherein the first portion pivots about the second portion between a first configuration and a second configuration, the reservoir being removable from the pivot assembly in the second configuration, and
wherein a portion of the locking assembly extends into the first portion to engage the reservoir in the first configuration.

12. The spray mop of claim 11, wherein the first portion defines a cup for receiving a portion of the reservoir.

13. The spray mop of claim 11, wherein the locking assembly includes a projection that extends into the first portion and is received by a channel on the reservoir to assist in retaining the reservoir in the first configuration.

14. The spray mop of claim 11, wherein the reservoir includes a recess that engages a detent provided on the second portion in the first configuration.

15. The spray mop of claim 11, wherein the reservoir pivot assembly includes a pump fluidly connecting the reservoir to a spray nozzle.

16. The spray mop of claim 11, wherein the reservoir is provided closer to the handle in the first configuration than in the second configuration.

17. A spray mop comprising:
a handle portion and a head portion attached to the handle portion;
a housing provided on the handle portion or the head portion movable between a first position and a second position;
a reservoir removably received by the housing such that when the reservoir is received by the housing the reservoir is connected to a liquid distribution system operable to deliver a fluid from the reservoir; and
a projection that extends into the housing to engage the reservoir in the first position and disengage the reservoir in the second position,
where the reservoir is removable from the housing in the second position.

18. The spray mop according to claim 17, where the housing is pivotably connected to the handle portion or the head portion moveable between the first position and the second position.

19. The spray mop according to claim 17, the retention assembly comprising a channel defined by a portion of the reservoir that engages the projection on one of the handle portion or the housing in the first position.

20. The spray mop according to claim 17, where the housing moves between the first position and the second position by a pivoting movement, and the reservoir travels with the housing between the first position and second position.

* * * * *